United States Patent [19]

Gee

[11] 4,119,389

[45] Oct. 10, 1978

[54] RADIALLY REMOVABLE TURBINE VANES

[75] Inventor: Ted F. Gee, Greenwood, Ind.

[73] Assignee: General Motors Corporation, Detroit, Mich.

[21] Appl. No.: 759,911

[22] Filed: Jan. 17, 1977

[51] Int. Cl.[2] ..... F01D 9/04

[52] U.S. Cl. ..... 415/189; 416/215; 416/222

[58] Field of Search ..... 415/189, 185; 416/215, 416/216, 217, 218, 221, 204 R, 204 A, 222

[56] References Cited

U.S. PATENT DOCUMENTS

| | | | |
|---|---|---|---|
| 3,053,504 | 9/1962 | Shelley | 416/215 |
| 3,954,350 | 5/1976 | Zahring | 416/215 |
| 3,955,898 | 5/1976 | Zaehring | 416/215 |

FOREIGN PATENT DOCUMENTS

| | | | |
|---|---|---|---|
| 659,592 | 10/1951 | United Kingdom | 416/215 |
| 815,506 | 6/1959 | United Kingdom | 416/218 |

*Primary Examiner*—Carlton R. Croyle
*Assistant Examiner*—Donald S. Holland
*Attorney, Agent, or Firm*—J. C. Evans

[57] ABSTRACT

A gas turbine engine has a turbine vane case, an outer combustion case and inner vane case along with an air seal located in circumferential surrounding relationship to a circumferential row of stator vanes defining a turbine nozzle assembly upstream of a high pressure turbine stage. Individual stator vanes can be replaced without removing the high pressure turbine stage by configuring an index vane to be removably secured to an inner support band by means of a spring loaded pin and configuring each of the remaining vanes in the vane row to have a side slotted base secured to the inner band and removable therefrom by rotation of each of the individual vanes in a direction opposite to the tangential gas load thereon.

4 Claims, 4 Drawing Figures

RADIALLY REMOVABLE TURBINE VANES

BACKGROUND OF THE INVENTION

The invention herein described was made in the course of work under a contract or subcontract thereunder with the Department of Defense.

This invention relates to turbine nozzle guide vane assemblies and more particularly to such assemblies wherein individual ones of the vanes are radially removable from the assembly without removing an associated high pressue turbine wheel and blade assembly.

In gas turbine engines it is desirable that individual vanes or complete vane rows be replaced without removing a downstream high pressure turbine wheel and blade assembly in order to maintain a desired axially set rotor position.

Furthermore, it is recognized that radially replaceable guide vane assemblies further enable special air flow configurations to be included upstream of a turbine nozzle guide vane assembly to produce a smooth transition for flow from the combustion liner of a gas turbine engine into the nozzle guide vane row upstream of a high pressure turbine stage. Various proposals have been suggested to support stator units within a gas turbine engine in a way that they can be removed without disturbing a downstream turbine wheel and blade assembly. An example of such an arrangement is set forth in the U.S. Pat. No. 2,654,566, issued Oct. 6, 1953 to W. Boyd et al. It discloses an arrangment wherein individual guide vanes can be removed separately and replaced if they become worn or damaged. In such an arrangement a clamping band encircles all blades. It requires adjustment to maintain a desired snug fit under both cold and hot operation of the engine.

Another arrangement that permits an individual stator vane removable in a direction upstream of a downstream turbine wheel and vane assembly is set forth in the U.S. Pat. No. 2,984,454, issued May 16, 1961 to B. M. Fiori. However, in this arrangement it is necessary to remove a transition duct 104 thereby disturbing the set relationship of it with respect to the remaining portions of the gas turbine engine.

An object of the present invention is to provide an improved gas turbine nozzle guide vane construction in which individual vanes or a complete vane row can be replaced from the gas turbine engine without disturbing the set of a downstream turbine wheel and blade assembly or an upstream guide air foil configuration for providing a smooth transition from an upstream combustor into the turbine nozzle guide vane inlet.

Another object of the present invention is to provide an improved turbine vane stator assembly including means for radially removing individual vanes or a complete vane row from upstream of a turbine wheel and blade assembly without disturbing it and to do so by a first index vane secured to an inner support band by a single axially loaded pin and by the further porvision of individual vanes each having side slotted base portions thereon engageable with a fixed pin on the inner band for preventing radial shift of the individual vanes while enabling each of the other individual vanes to be rotated in a direction opposite to tangential gas loads on the vanes to free them for removal radially of the gas turbine engine.

Further objects and advantages of the present invention will be apparent from the following description, reference being had to the accompanying drawings wherein a preferred embodiment of the present invention is clearly shown.

DESCRIPTION OF THE PREFERRED EMBODIMENTS

Figure 1:
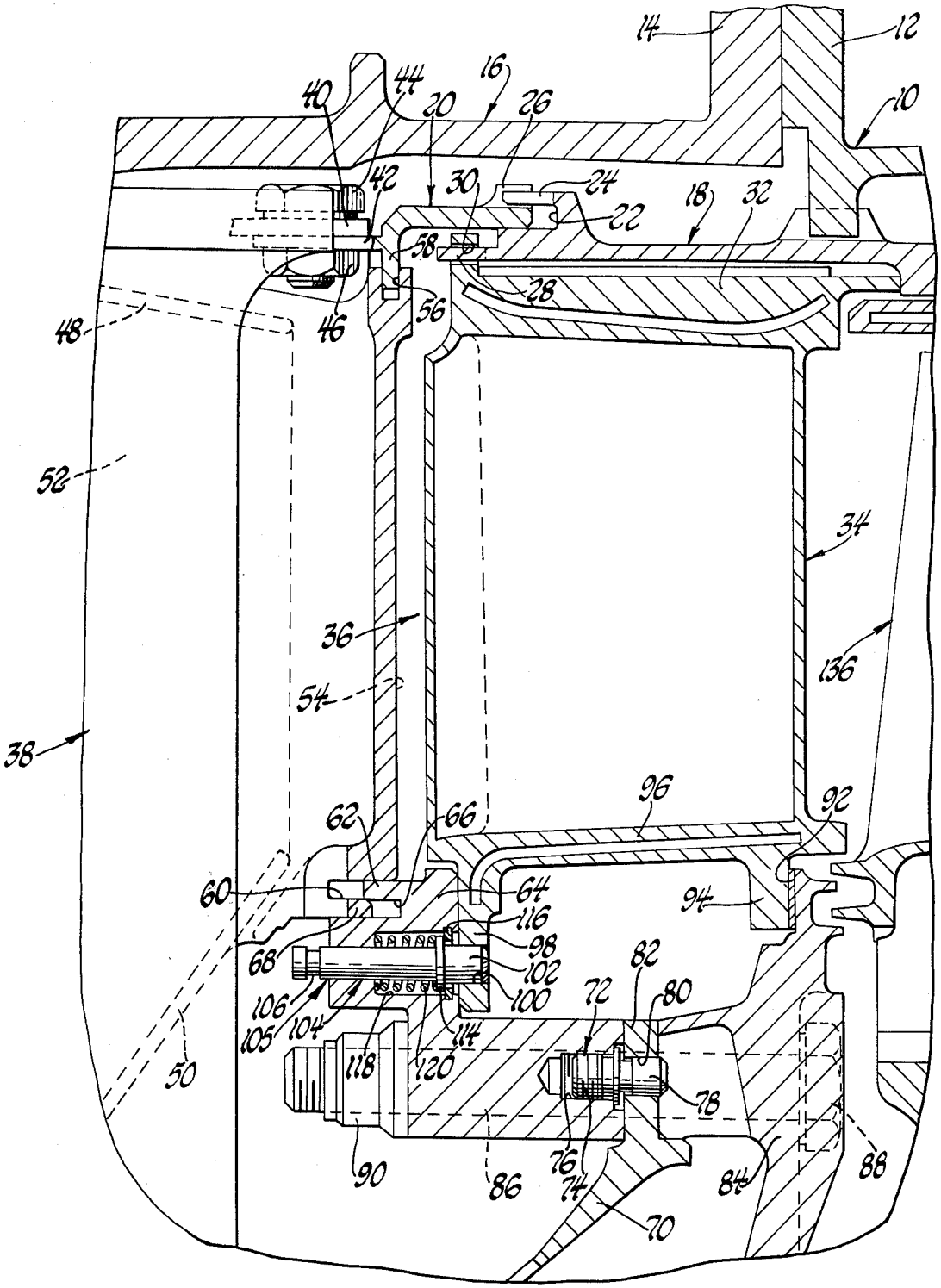
FIG. 1 is a fragmentary view in vertical section showing one vane of the improved turbine nozzle guide vane assembly of the present invention.

In FIG. 1, a fragmentary segment of a gas turbine engine is illustrated including a turbine vane case 10 having a peripheral flange 12 thereon located in juxtaposed engagement with a peripheral flange 14 of an outer combustion case 16 of the gas turbine engine. Additionally, the structure includes an inner vane case 18 and an associated air seal ring 20.

The inner vane case 18 includes an axially forwardly facing slot 22 therein and a plurality of circumferentially spaced tangs 24 interlocked with respect to radially outwardly directed tabs 26 on the air seal ring 20. Additionally, the inner vane case 18 includes a second plurality of circumferentially spaced tangs 28 thereon each axially positioned within a slot 30 on the outer radial flange 32 of an index vane 34 in a turbine vane nozzle construction 36 in accordance with the present invention. Upstream of the vane nozzle assembly 36 is located a combustor discharge air foil configured guide assembly 38 that includes an outer radial segment 40 thereon which supportingly receives a forward flange segment 42 of the air seal ring 20 which is secured to the segment 40 by means of a threaded screw element 44 and nut 46.

The air foil configured guide assembly 38 includes a pair of convergent wall segments 48, 50 defining a passage 52 from the combustor through an outlet 54 into the nozzle assembly 36. The outlet 54 includes a circumferentially formed, radially outwardly facing slot 56 which supportingly receives a dependent flange 58 on the air seal ring 20.

The outlet 54 includes an axially downstream facing slot 60 therein which receives one leg 62 of an inner support ring 64, ring 64 has a slot 66 to receive a flange 68 on the outlet 54 thereby to support the inner support ring 64 with respect to the combustor discharge air foil configured guide assembly 38.

The assembly 38 is therefore axially and radially fixed with respect to the nozzle assembly 36.

More particularly the inner support ring 64 is secured to a brace 70 by a plurality of fasteners 72 each including a threaded end 74 seated within a tapped opening 76 on a downstream surface of the inner support ring 64 as best seen in FIG. 1. Fasteners 72 further include a head 78 thereon press fitted within a bore 80 in the outer radial flange 82 of the brace 70. Additionally, the inner support ring 64 is secured to a turbine seal frame 84 by means of a plurality of studs 86 having a head portion 88 in engagement with the inboard face of the frame 84 and including a threaded outer end connected by means of a nut 90 to the upstream face of the inner support ring 64.

The frame 84 includes an annular, forwardly facing surface 92 thereon that supportingly receives a rear flange 94 on the base 96 of the index vane 34.

Figure 2:
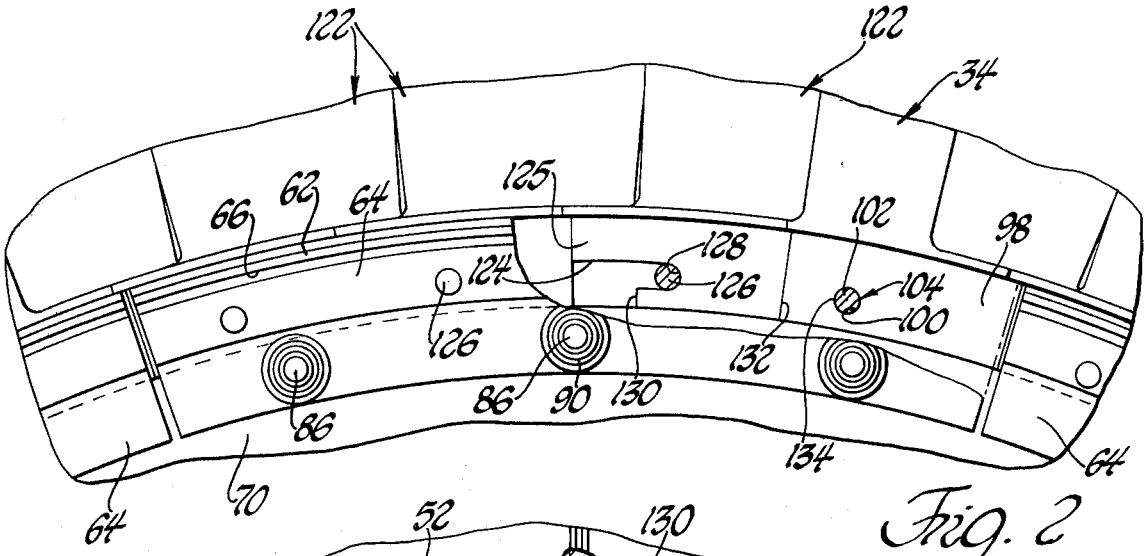
FIG. 2 is a fragmentary, front elevational view of an arcuate segment of the vane row construction of the present invention.

In the illustrated arrangement the index vane 34 is the key index point for a row of vanes in the vane nozzle assembly, a sector of which is illustrated in FIG. 2. The index vane 34 includes a front flange 98 thereon having a bore 100 into which a plunger head 102 on a release or lock pin 104 of a release mechanism 105 is positioned. The release mechanism 105 also includes a recessed end segment 106 located below an access port 108 defined by opposed walls 110, 112 having an air foil curvature formed as part of the upstream combustor discharge air foil configured guide assembly 38.

The port 108 serves as an entrance for a tool to operate the mechanism 105. The pin 104 further includes a stop flange 114 thereon spring biased against a retention ring 116 fixedly secured within a bore 118 in the inner support ring 64. A coil spring 120 located within the bore is biased against the flange 114 to hold the pin 104 so that the plunger head 102 thereon will be in interlocked engagement with the bore 100 as best seen in FIG. 1.

When the vane 34 is in its indexed position as shown in FIGS. 1 and 2, it locates each of a plurality of circumferentially located, nozzle or indexed vanes 122 in an interlocked relationship with the inner support ring 64.

More particularly, when in their locked position, each of the vanes 122 is located so as to position a side slot 124 in a base 125 thereon with respect to a fixed retainer or retention pin 126 on the ring 64 as shown in FIG. 2. At this point, each of the retainer pins 126 is located against a semicircular end segment 128 of the groove 124 and has a diameter corresponding to the height of the groove 124 at the end segment 128 thereon to serve as a stop against radial movement of a vane 122 with respect to the inner support ring 64.

Additionally, the slot 124 is undercut at 130, a distance corresponding to that between a reference surface 132 on the right hand side of each vane 122 as viewed in FIG. 2 and a point of contact 134 on a clockwise located reference portion of an adjacent fixed fastener 126. In the illustrated arrangement, as shown in FIG. 2 the ring 64 is formed as a plurality of sectors each being held in place by means of the studs 86 and nuts 90 as shown in FIG. 2.

Figure 3:
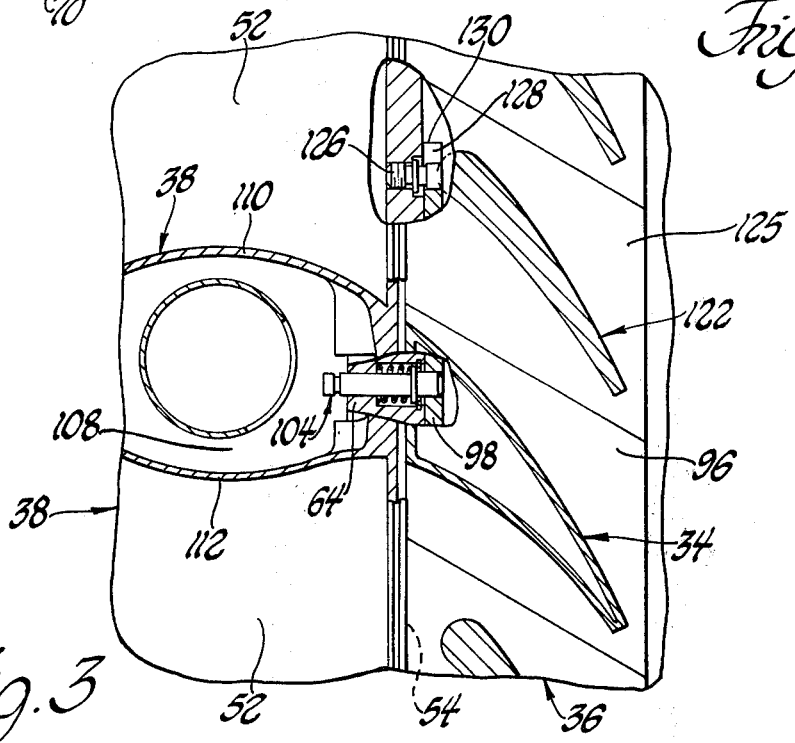
FIG. 3 is a top elevational view, partially broken away, and in cross section to show an axially loaded lock pin and side slot and fixed retainer pin components of the present invention.
Figure 4:
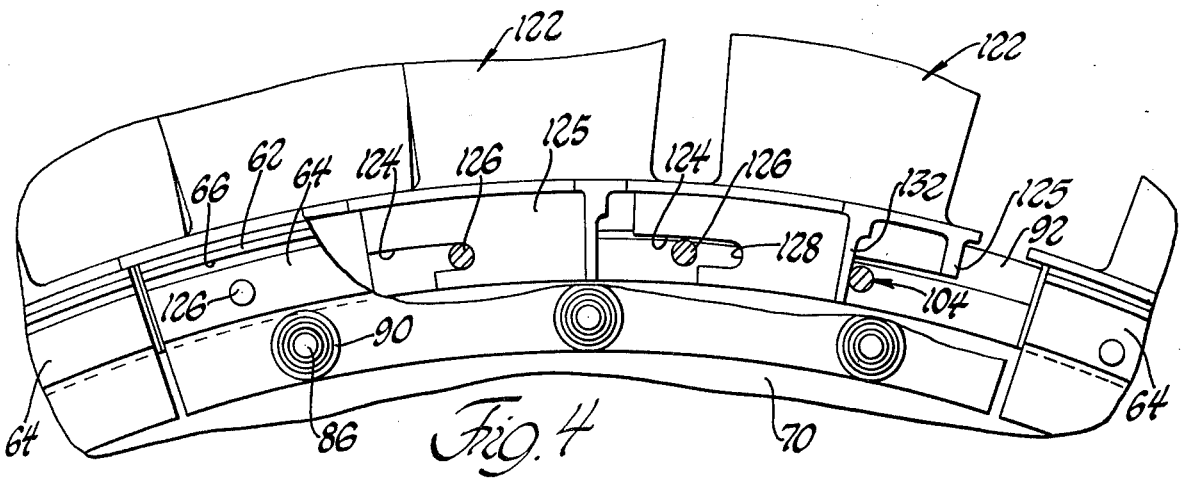
FIG. 4 is a view in elevation showing one of the side slotted vane components of the present invention in a location prior to radially directed removal.

The base 125 on each of the vanes 122 is seated between the reference surface 92 and the ring 64. These surfaces serve as a means for slidably guiding the individual vanes 122 from a locked position on the support ring 64 to a release position as shown in FIG. 3.

It engines of the aforesaid type the turbine vane case 10, outer combustion case 16, inner vane case 18 and air seal ring 20 are removed from exteriorly of the engine to provide access to the vane nozzle assembly 36. Such removal does not disturb the set of the upstream combustor air foil configured guide assembly 38 as well as that of a downstream turbine stage 136. This is the case since individual vanes or complete vane rows can be replaced without removing the downstream turbine stage 136 or otherwise disturbing the axial set of the rotor components thereof.

Furthermore, the special air foil configured guide assembly 38 defining a smooth transition from the combustion liner into the turbine stage 136 can be maintained set behind existing radial struts in the engine.

The arrangment is such that there are no additional air leakage paths into the gas stream because the mechanism 105 can be tripped by means of a tool directed through the access port 108 in an area away the gas stream flow through the engine.

In practicing the present invention, once the outer casing components are removed the spring biased release pin 104 is pulled to the left as viewed in FIG. 1 until the plunger head 102 is removed from the bore 100. At this point the index vane 34 can be removed radially outwardly of the vane row 36. Thereafter, the remainder of the vanes 122 can be removed one at a time by rotating each of the vanes 122 in a direction opposite to the tangential gas load direction on each of the vanes 122 under operating conditions. As each of the vanes 122 is shifted one at a time in a clockwise direction the slot 124 clears the fixed retainer pin 126 and the reference surface 132 as indexed against the next adjacent retainer pin so that, once shifted in a circumferential direction as seen in FIGS. 2 and 3, the individual nozzle vanes 122 can be removed from the inner support ring 64. This sequence can be repeated in order to provide ready removal of burned out or worn individual parts in the overall assembly.

As stated above, each of the side slots 124 and the fixed retainer pins 126 release in a direction opposite to the gas loading on the individual vanes 122. Conversely, during gas turbine engine operation the tangential gas load on each of the individual vanes 122 is in a direction to cause the base 125 to be pressure biased in a direction to seat the fixed retainer pin 126 against the adjacent end segment 128 of each slot 124 to assure a radial interlock of each of the individual vanes 122 with respect to the inner support ring 64. When the index vane 34 is in place and the spring biased release mechanism 105 is locked as shown in FIG. 1, the full assembly is interlocked with respect to the support ring 64 to maintain a spring biased and pressure loaded configuration wherein each of the individual vane segments of the nozzle assembly 36 is secured against separation from the support ring 64 while retaining the capability of selective and quick removal of any or all of the vanes in the assembly.

While the embodiments of the present invention, as herein disclosed, constitute a preferred form, it is to be understood that other forms might be adopted.

The embodiments of the invention in which an exclusive property or privilege is claimed are defined as follows:

1. A radially removable stator vane array for gas turbine engines with gas flow paths therethrough comprising: an inner support ring, a first removable index vane having a base, a lock pin slidably supported in said ring including a head thereon interlocked with said base, spring means for axially loading said lock pin to maintain said head interlocked with said base and to permit retraction of said pin from said base, a plurality of circumferentially located indexed vanes on said ring on either side of said index vane, each of said indexed vanes having a base with a side slot therein, a plurality of fixed retention pins on said ring each interlocked with each of said slots to hold each of said indexed vanes thereon, said index vane being radially removable from said ring when said lock pin is retracted, each of said indexed vanes being circumferentially movable when said index vane is removed to shift the side slots therein from said fixed retention pins for positioning each indexed vane for subsequent radial separation from said ring.

2. A radially removable stator vane array for gas turbine engines with gas flow paths therethrough comprising: an inner support ring, a first removable index vane having a base, a lock pin slidably supported in said ring including a head thereon interlocked with said base, spring means for axially loading said lock pin to maintain said head interlocked with said base and to permit retraction of said pin from said base, a plurality of circumferentially located indexed vanes on said ring on either side of said index vane, each of said indexed vanes having a base with a side slot therein, a plurality of fixed retention pins on said ring each interlocked with each of said slots to hold each of said indexed vanes thereon, said index vane being radially removable from said ring when said lock pin is retracted, each of said indexed vanes being circumferentially movable when said index vane is removed to shift the side slots therein from said fixed retention pins for positioning each indexed vane for subsequent radial separation from said ring, said lock pin having an outboard end, means forming an access port to insert a tool to engage the outboard end of said lock pin without entering gas flow paths though the engine.

3. A gas turbine engine comprising an axially set combustor discharge duct and an axially set downstream turbine, a radially removable nozzle assembly located between said duct and said turbine, said nozzle assembly including, a radially inboard support ring, a first removable index vane having a base thereon, a lock pin slidably supported in said ring including a head thereon interlocked with said base, spring means for axially loading said lock pin to maintain said head interlocked with said base and to permit retraction of said pin from said base, a plurality of circumferentially located indexed vanes on said ring on either side of said index vane, each of said indexed vanes having a base with a side slot therein, a plurality of fixed retention pins on said ring each interlocking with each of said slots to hold each of said indexed vanes thereon, said index vane being radially removable from said ring when said lock pin is retracted, each of said indexed vanes being circumferentially movable when said lock vane is removed to shift the side slots therein from said fixed retention pins for positioning each indexed vane for subsequent radial separation from said ring.

4. A gas turbine engine comprising an axially set combustor discharge duct and an axially set downstream turbine, a radially removable nozzle assembly located between said duct and said turbine, said nozzle assembly including, a radially inboard support ring, a first removable index vane having a base thereon, a lock pin slidably supported in said ring including a head thereon interlocked with said base, spring means for axially loading said lock pin to maintain said head interlocked with said base and to permit retraction of said pin from said base, a plurality of circumferentially located indexed vanes on said ring on either side of said index vane, each of said indexed vanes having a base with a side slot therein, a plurality of fixed retention pins on said ring each interlocking with each of said slots to hold each of said indexed vanes thereon, said index vane being radially removable from said ring when said lock pin is retracted, each of said indexed vanes being circumferentially movable when said lock vane is removed to shift the side slots therein from said fixed retention pins for positioning each indexed vane for subsequent radial separation from said ring, said lock pin having an outboard end, said combustor discharge duct having wall segments defining an access port through the duct for insertion of a tool to engage the outboard end of said lock pin without entering the discharge duct gas path.

* * * * *